US006560969B1

(12) United States Patent
Eckels

(10) Patent No.: US 6,560,969 B1
(45) Date of Patent: May 13, 2003

(54) PULSE TUBE REFRIGERATION SYSTEM HAVING RIDE-THROUGH

(75) Inventor: Phillip William Eckels, Florence, SC (US)

(73) Assignee: GE Medical Systems Global Technology, Co., LLC, Waukesha, WI (US)

( * ) Notice: Subject to any disclaimer, the term of this patent is extended or adjusted under 35 U.S.C. 154(b) by 0 days.

(21) Appl. No.: 10/063,269

(22) Filed: Apr. 5, 2002

(51) Int. Cl.[7] ..... F25B 9/00
(52) U.S. Cl. ..... 62/6
(58) Field of Search ..... 62/4, 236

(56) References Cited

U.S. PATENT DOCUMENTS 5,410,286 A * 4/1995 Herd et al. ..... 335/216
5,808,376 A * 9/1998 Gordon et al. ..... 307/66
6,412,290 B1 * 7/2002 Okumura et al. ..... 62/55.5

* cited by examiner

*Primary Examiner*—William C. Doerrler
*Assistant Examiner*—Malik N. Drake
(74) *Attorney, Agent, or Firm*—Michael A. Della Penna

(57) ABSTRACT

A method and system for providing a ridethrough reserve for a pulse tube refrigerator (PTR) (12) includes a pressurized tank (42) containing a fluid used to provide fluid pressure and auxiliary power to a PTR (12) during an electrical power supply failure. A pressure regulation valve (pressure valve) (44) releases the fluid from the pressurized tank (42) into the PTR (12). A power regulation valve (power valve) releases from the pressurized tank (12) a driving gas volume for driving a pneumatic motor (46). The pneumatic motor (46) in turn drives a rotary valve (22) of the PTR (12). A release valve (50) releases fluid from the PTR (12) so as to lower the fluid pressure to a predetermined pressure range and enable fluid oscillation in the PTR (12).

20 Claims, 3 Drawing Sheets

PULSE TUBE REFRIGERATION SYSTEM HAVING RIDE-THROUGH

BACKGROUND OF INVENTION

The present invention relates generally to a pulse tube refrigerator (PTR), and particularly to a pulse tube refrigeration system (PTRS) with an auxiliary power source.

The introduction of the magnetic resonance imaging (MRI) scanner in the 1970s has revolutionized diagnostic medicine. The MRI scanner employs a magnetic field and a plurality of radio frequency signals to permit instant mapping and analysis of bodily tissue.

A typical MRI scanner includes superconducting magnets. As one skilled in the art would understand, a superconducting magnet is comprised of coils or windings of wire through which a current of electricity is passed for generating the magnetic field. Further, the wire is typically cooled by helium liquid so as to render the wire superconducting, a current therethrough persistent, and the magnet independent of the power system.

Current MRI scanners may use a pulse tube refrigerator (PTR) to cool the superconducting magnet. The PTR typically includes an electric compressor and a rotary valve driven by an electric motor. Unless an uninterruptible power supply provides an MRI scanner with the necessary power, an MRI scanner usually must shut down during a power failure. Moreover, a superconducting magnet may quench if it has an insufficient liquid cryogen reserve. As one skilled in the art would understand, quenching describes the process in which the superconductor becomes resistive thereby expelling nearly all of the cryogens, blowing the burst disk, and ultimately necessitating magnet re-ramp. As a result, costly processes may be required to return the magnet to operating condition. For example, the expensive endeavor of reshimming the magnetic field on re-ramp may be required. Such a result is clearly undesirable.

Therefore, a need exists to provide a pulse tube refrigeration system (PTRS) that continues to operate the PTR of an MRI scanner in the event of a power failure, i.e. ride-through a power outage.

SUMMARY OF INVENTION

It is an object of the present invention to permit a pulse tube refrigerator (PTR) to operate in the event of an electrical power supply failure. It is yet another object of the present invention to improve the cooling efficiency of the PTR.

In accordance with the above and other objects of the present invention, a method and system are provided for maintaining proper fluid pressure within a PTR during an electrical power supply failure.

There is disclosed herein a method and system for providing a ridethrough reserve for a PTR. The method and system include a pressurized tank containing a fluid used to provide a desired fluid pressure and an auxiliary power to a PTR during an electrical power supply failure. A pressure regulation valve (pressure valve) releases the fluid from the pressurized tank into the PTR. A power regulation valve (power valve) releases from the pressurized tank a driving gas volume for driving a pneumatic motor. The pneumatic motor drives a rotary valve of the PTR. A release valve releases fluid from the PTR so as to lower the fluid pressure to a predetermined pressure range.

Other objects and advantages of the present invention will become apparent upon reading the following detailed description and appended claims, and upon reference to the accompanying drawings.

BRIEF DESCRIPTION OF DRAWINGS

For a more complete understanding of this invention, reference should now be had to the embodiments illustrated in greater detail in the accompanying drawings and described below by way of examples of the invention. In the drawings.

DETAILED DESCRIPTION

The present invention is illustrated herein with respect to a pulse tube refrigeration system (PTRS), particularly suited for magnetic resonance imaging (MRI) scanners. However, the present invention is applicable to various other uses that may require refrigeration.

Figure 1:
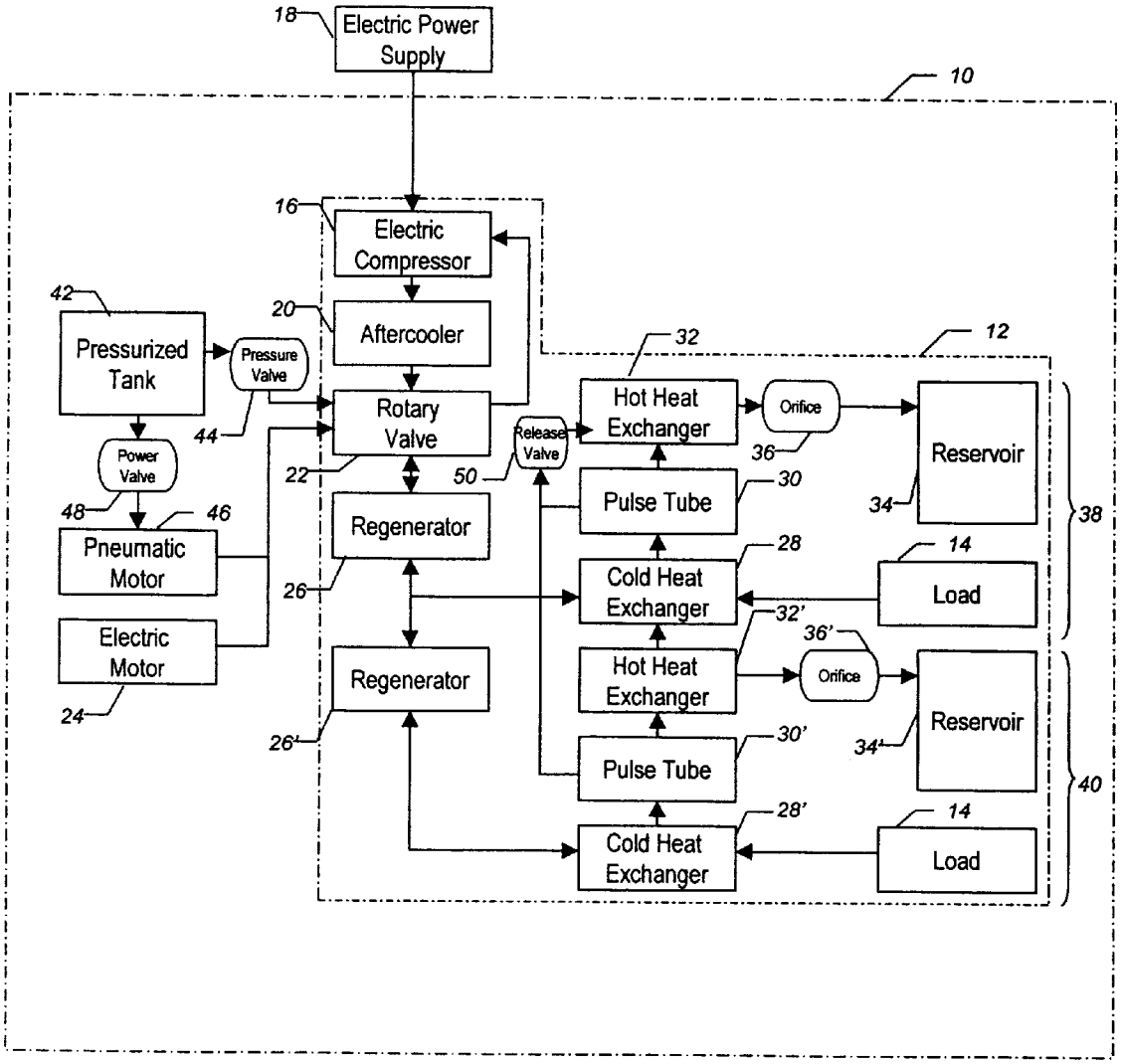
FIG. 1 is a schematic diagram representing a pulse tube refrigeration system (PTRS) with ride-through according to a preferred embodiment of the present invention.

Referring to FIG. 1, a pulse tube refrigeration system (PTRS) 10 having ride-through is illustrated according to a preferred embodiment of the present invention. In this regard, the term ride-through comprises an auxiliary power reserve provided by a pressurized fluid that serves as a cooling fluid of the PTRS 10 and a driving force of pneumatic components.

The PTRS 10 includes a conventional pulse tube refrigerator 12 (PTR) and employs a fluid (not shown) for cooling a load 14, such as an MRI magnet. Helium generally is the preferred working fluid used in a PTR. However, other fluids may be utilized.

The PTR 12 includes an electric compressor 16 typically powered by an external electrical power supply 18. The electric compressor 16 may be composed of dual opposed reciprocating pistons. Such a configuration typically reduces vibrations in the PTRS. Of course, other configurations of the compressor may be used as desired. The electric compressor 16 increases a fluid pressure of the fluid to a predetermined pressure range. A PTR for an MRI scanner typically requires a predetermined pressure range having a minimum pressure value of 1.75 atmospheres and a maximum pressure value of 6.0 atmospheres. Clearly, the pressure oscillation range may be otherwise as the system so requires. As one skilled in the art would understand, the electric compressor 16 increases the fluid pressure thereby increasing the fluid temperature. An aftercooler 20 is coupled to the electric compressor 16 and receives the fluid therefrom. In the aftercooler 20, heat is removed from the fluid to enhance its cooling capacity. Typically, the fluid is cooled by transferring heat from the fluid to a water-cooling loop (not shown) adjacently coupled to the aftercooler 20. A rotary valve 22 is coupled to the aftercooler 20 and receives the fluid from the aftercooler 20. Driven by an electric motor 24, the rotary valve 22 oscillates the fluid pressure between the minimum and maximum pressure values of the predetermined pressure range. For an MRI scanner, the rotary valve preferably oscillates the fluid pressure between 1.75 atmospheres and 6.0 atmospheres. As mentioned above, the pressure oscillation range may be otherwise as desired. A regenerator 26 is coupled to the rotary valve 22 to receive the fluid from the rotary valve 22. As is known in the art, the regenerator 26 does not transfer heat between the fluid and external sources, yet it maintains an existing low temperature of the fluid so as to optimize the cooling capability of the fluid. A cold heat exchanger 28 is coupled to the regenerator 26 and receives the fluid from the regenerator 26. In the cold heat exchanger 28, the fluid receives heat from a load 14 in the PTRS 10. The load 14 may be a superconducting magnet for an MRI scanner, as well as various other heat sources that require refrigeration.

A pulse tube 30 is coupled to the cold heat exchanger 28 and receives the fluid therefrom. In the pulse tube 30, a desired phase relationship between fluid pressure and fluid flow permits heat to be transported from a cold end (not shown) of the pulse tube 30 to a warm end (not shown) of the pulse tube 30. In other words, the phase relationship allows for a transport of the heat through the pulse tube 30, away from the load 14.

A hot heat exchanger 32 is coupled to the warm end of the pulse tube 30 and receives the fluid therefrom. In the hot heat exchanger 32, heat is transferred from the fluid through a surface of the hot heat exchanger 32 to a heat sink. Typically, the heat sink is a flow of air circulated through the PTR 12 over the surface of the hot heat exchanger 32.

A reservoir 34 is operatively coupled to the hot heat exchanger 32 through an orifice 36. As is known in the art, the orifice 36 and reservoir 34 cooperate to provide the necessary phase shift that allows for the desired heat flow within the PTR 12.

In a preferred embodiment of the invention, as shown in FIG. 1, the PTR 12 has a dual stage configuration for enhancing refrigeration capacity. The dual stage includes a first stage 38 and a similar second stage 40. The first stage includes the regenerator 26, cold heat exchanger 28, pulse tube 30, hot heat exchanger 32, orifice 36, and reservoir 34. Interconnected and operating similarly to the first stage, the second stage preferably includes the regenerator 26", cold heat exchanger 28", pulse tube 30", hot heat exchanger 32", orifice 36", and reservoir 34". Pursuant to the dual stage configuration, the cold heat exchanger 28 in the first stage 38 cools the hot heat exchanger 32" in the second stage 40, in addition to removing heat from the 14. Consequently, the cooling capacity of the cold heat exchanger 28" in the second stage 40 is enhanced.

The PTRS 10 further includes a pressurized tank 42 containing a reserve supply of the fluid (e.g. helium) for cooling the load 14 during an electrical power supply failure. In operation, the pressurized tank 42 supplies the PTRS 10 with fluid pressure within the predetermined pressure range.

A pressure regulation valve (pressure valve) 44 couples the pressurized tank 42 to the rotary valve 22 of the PTR 12. The pressure valve 44 selectively releases the fluid from the pressurized tank 42 into the PTR 12 during an electrical power supply failure. Preferably, the pressure valve 44 is a pressure and flow line tap. As one skilled in the art would understand, a pressure and flow line tap permits fluid to flow therethrough when a predetermined pressure differential arises across the tap. For example, a tap permitting flow therethrough at a pressure differential of 6.25 atmospheres requires a pressure difference across the tap of at least 6.25 atmospheres before fluid may be permitted therethrough. In this regard, a PTR 12 requiring a minimum fluid pressure of 1.75 atmospheres and including a pressurized tank 42 at 8.0 atmospheres typically requires a tap permitting flow therethrough at a pressure differential of 6.25 atmospheres. As a result, the additional pressurized fluid is injected into the PTR 12 thereby increasing fluid pressure within the PTR 12, as well as the volume of working fluid within the PTR 12.

A pneumatic motor 46 is coupled to the rotary valve 22 and drives it during an electrical power supply failure. More specifically, a typical attachment may involve the pneumatic motor 46 being coupled to a drive shaft (not shown) of the rotary valve 22. A power regulation valve (power valve) 48 selectively releases the fluid from the pressurized tank 42 to drive the pneumatic motor 46 during an electrical power supply failure. The power valve 48 is preferably a solenoid valve that remains closed while a supply of electricity is provided thereto. Of course, the power valve 48 may include any other valve that electromagnetically remains closed by the supply of electricity. During a power supply failure, the power valve 48 opens so as to release fluid from the pressurized tank 42 for driving the pneumatic motor 46. Thereafter, the fluid is released from the motor 46 and flows over a surface of the hot heat exchanger 32 to remove heat therefrom and enhance the refrigeration process. The fluid may also be used to cool other elements of the invention for improving refrigeration.

A release valve 50 is preferably coupled to the PTR 12 for decreasing the fluid pressure within the PTR 12. More specifically, the release valve 50 is preferably coupled to the pulse tubes 30, 30" to selectively release fluid from the PTR 12 when the fluid pressure rises beyond a predetermined pressure range. Similar to the pressure valve 44, the release valve 50 preferably is a pressure and flow line tap that permits fluid flow therethrough upon the existence of a predetermined pressure differential. The release valve 50 may release fluid from the PTR 12 only when the fluid pressure rises above a maximum fluid pressure. A typical maximum fluid pressure is about 2.0 atmospheres. Of course, one skilled in the art would understand that various other pressure thresholds may be employed. Further, the release valve 50 preferably releases the fluid over a surface of the hot heat exchanger 32 to optimize the refrigeration process. It is also clear to one skilled in the art that the released fluid may cool other elements of the PTR 12 for improving the refrigeration process.

Figure 2:
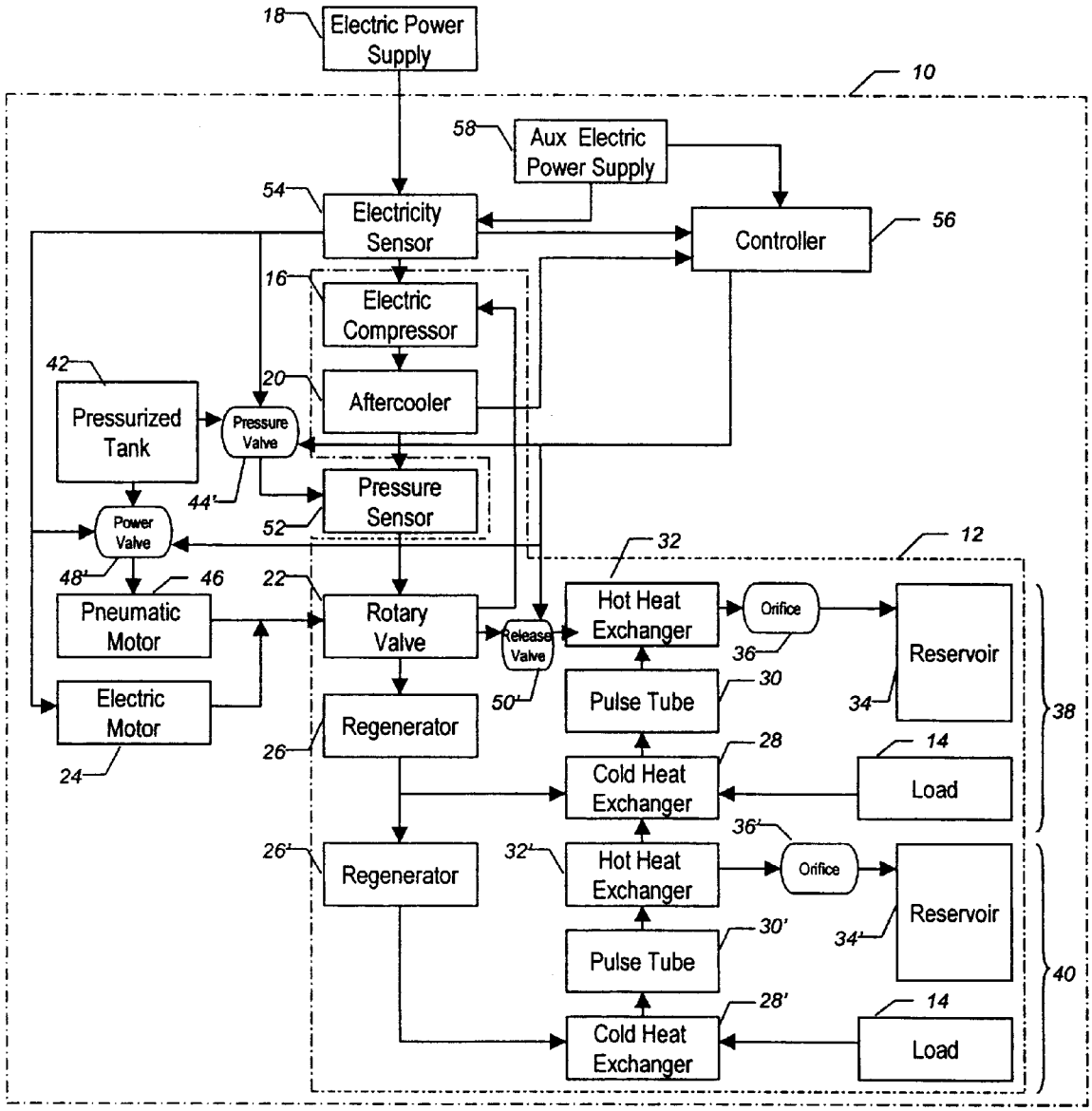
FIG. 2 is a schematic diagram representing a PTRS with ride-through according to an alternative embodiment of the present invention.

Turning now to FIG. 2, there is illustrated a PTRS 10 according to an alternative embodiment of the present invention. The alternative embodiment includes all of the elements of the preferred embodiment with modifications to the pressure regulation valve 44" (pressure valve), power regulation valve 48" (power valve), and the release valve 50". The alternative embodiment requires these valves 44", 48", and 50" to be actuated by a controller 56 and powered by an auxiliary electrical power supply 58. Known to one skilled in the art, the controller may also include fluid logic elements for providing its power and mastering its control function. The actuation of the valves 44", 48", 50" and the controller 56 permits the fluid within the pressurized tank 42 to provide the ride-through reserve power. The electrical demand for actuation of the valves 44", 48", 50" and the controller 56 is typically substantially less than the electrical demand required to operate the electrical compressor. Thus, the auxiliary electrical power supply may be an array of batteries, an internal combustion engine power generator, or any other power source as desired.

In addition, the PTRS 10 further includes at least one pressure sensor 52 coupled to the PTR 12 for detecting the fluid pressure within the PTR 12 and pressure oscillation within therein. More specifically a pressure sensor 52 is preferably coupled to the rotary valve 22 for detecting fluid pressure and pressure oscillation within the PTR 12. Moreover, at least one electricity sensor 54 is coupled to the PTR 12 to detect whether a sufficient electrical current is being provided to the electric compressor 16, pressure valve 44, and power valve 48.

The controller 56 is electrically coupled to pressure sensor 52 and the electricity sensor 54. The controller 56 determines whether the fluid pressure is within the predetermined pressure range and whether the electrical current is sufficient to operate the electrical components of the PTRS 10.

Figure 3:
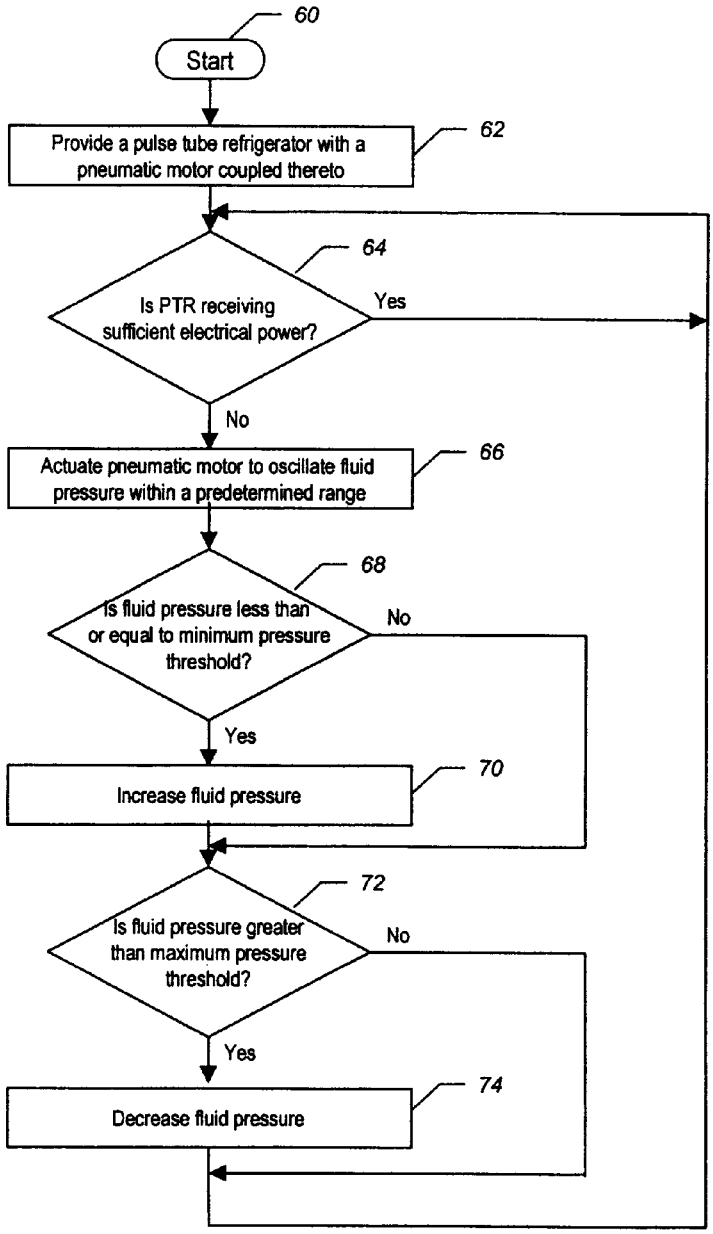
FIG. 3 is a flowchart depicting a method for providing a ridethrough reserve for a pulse tube refrigerator (PTR).

Referring now to FIG. 3, a flowchart illustrates a method for providing a ridethrough power reserve for a pulse tube refrigerator (PTR) 12. In operation, the method of the present invention is initiated at step 60 and then immediately proceeds to step 62. In step 62, a PTR 12 and a pneumatic motor 46 are provided according to the description for FIG. 1. Then, the sequence immediately proceeds to inquiry block 64.

In inquiry block 64, it is generally determined whether sufficient electrical power is being supplied to the PTR 12. For a positive answer to inquiry block 64, no ride-through reserve power is needed and consequently the sequence merely repeats inquiry block 64. For a negative answer to inquiry block 64, the sequence proceeds to step 66. In step 66, the pneumatic motor is generally actuated so as to drive a rotary valve 22 and oscillate the fluid pressure within a predetermined pressure range. A typical predetermined pressure range approximately includes the values from 1.75 atmospheres to 6.0 atmospheres.

More specifically, in a preferred embodiment, steps 64 and 66 are accomplished by merely employing a solenoid valve as a power regulation valve 48 operatively coupled between the pneumatic motor 46 and a pressurized tank 42. The solenoid valve has an electrical current supplied therethrough to an electrical compressor 16 that oscillates fluid pressure when ride-through power reserve is unnecessary. The solenoid valve remains closed if sufficient electrical power is being supplied so as to operate the electrical compressor 16 and electromagnetically bias the valve closed. In the event of a power failure, the valve automatically opens thereby permitting a flow of a driving gas volume therethrough from the pressurized tank 42 to the pneumatic motor 46. Typically, the driving gas volume actuates the pneumatic motor 42 so as to rotate a drive shaft of a rotary valve 22 coupled thereto. The rotary valve 22 then continues to oscillate the fluid pressure within the predetermined pressure range.

In an alternative embodiment, steps 64 and 66 are accomplished by using a controller 56 to detect the amount of electricity provided to the PTR 12. In particular, the controller 56 uses an electricity sensor 54 to detect the amount of electricity supplied to the PTR 12. For example, the electricity sensor 54 is may be coupled to the electric motor 24 for detecting the amount of electricity supplied thereto. Of course, the electricity sensor 54 may be coupled to other suitable electronic devices of the PTR 12 as desired.

If the controller 56 detects an insufficient supply of electricity, the controller 56 may actuate a power regulation valve 48" to release fluid from a pressurized tank 42. The released fluid may then drive the pneumatic motor 46 thereby providing the necessary power to operate the PTR 12. Then, the sequence proceeds to inquiry block 68.

In inquiry block 68, it is generally determined whether the fluid pressure within the PTR 12 is below a minimum pressure threshold. A typical value for the minimum pressure threshold may be about 6.0 atmospheres. However. The minimum pressure threshold may vary as desired. If the fluid pressure is above the minimum pressure threshold, then the sequence returns to step 64. If, however, the fluid pressure has decreased below the minimum pressure threshold, then the sequence proceeds to step 70 in which the fluid pressure is increased.

In greater detail, steps 68 and 70 are preferably accomplished by integrating a pressure and flow line tap with the pressure valve 44. The pressure valve 44 is operatively coupled between the pressurized tank 42 and the rotary valve 22. As one skilled in the art would understand, a pressure and flow line tap integrated with a valve automatically permits fluid to pass therethrough when a predetermined pressure differential exists across the valve. For example, a PTR 12 may require a minimum pressure of about 6.0 atmospheres and include a pressurized tank 42 containing fluid therein at or above 135 atmospheres. The tap would then automatically permit pressure regulated fluid to flow therethrough when a pressure differential of 2.0 atmospheres exists to the valve. Consequently, the pressure valve 44 automatically increases fluid pressure within the PTR 12 to the predetermined pressure range. Then the sequence returns to step 64.

Alternatively, steps 68 and 70 may be accomplished by employing a controller 56 to detect a fluid pressure within the PTR 12. In particular, the controller 56 may employ a pressure sensor 40 coupled to the rotary valve 22 for detecting fluid pressure therein. If in step 68, the controller detects that the fluid pressure is within the predetermined pressure range, then the sequence returns to step 64. If, however, the controller detects that the fluid pressure is below the minimum pressure threshold, then the sequence proceeds to step 70. In step 70, the controller 56 actuates a pressure valve 44" to open so as to release fluid from the pressurized tank 42 into the PTR 12. The released fluid consequently increases fluid pressure within the PTR 12 until the pressure sensor 40 detects that the fluid pressure is within the predetermined pressure range. The sequence then proceeds to step 72.

In step 72, the controller determines whether the fluid pressure in the heat exchanger 32 is greater than a maximum pressure threshold. A preferred maximum pressure threshold is about 3 atmospheres, however the maximum pressure threshold may vary as desired. If the fluid pressure less than or equal to the maximum pressure threshold, then the sequence immediately returns to step 64. However, if the fluid pressure is greater than the maximum pressure threshold, then the sequence proceeds to step 74 in which the fluid pressure is decreased.

In step 74, the controller 56 actuates the release valve 50" to open so as to release the fluid from the PTR 12 and to allow the fluid to vent over the hot heat exchanger 32. As fluid is released from the PTR 12 through the release valve 50", the pressurized tank 42 may supply replacement fluid to the PTR 12 through the pressure valve 44". In this regard, the fluid may oscillate within the first stage 38 and second stage 40 of the PTR 12 as required for proper operation. Having completed a full cycle of operation, the method returns to step 64.

While particular embodiments of the present invention have been shown and described, numerous variations and alternate embodiments will occur to those skilled in the art. Accordingly, it is intended that the invention be limited only in terms of the appended claims.

What is claimed is:

1. A system for providing a ridethrough reserve for a pulse tube refrigerator, the system comprising:

a pressurized tank containing a fluid for cooling a load;

a pressure regulation valve coupling said pressurized tank to a rotary valve of the pulse tube refrigerator, said pressure regulation valve releasing said fluid from said pressurized tank and increasing a fluid pressure within the pulse tube refrigerator to a predetermined pressure range during said electrical power supply failure;

a pneumatic motor operatively coupled to said rotary valve, said pneumatic motor driving said rotary valve during said electrical power supply failure;

a power regulation valve coupling said pressurized tank to said pneumatic motor, said power regulation valve providing a driving gas volume for driving said pneumatic motor during said electrical power supply failure; and a release valve coupled to the pulse tube refrigerator for decreasing said fluid pressure to said predetermined pressure range during said electrical power supply failure.

2. The system as recited in claim 1 wherein said load is a superconducting magnet.

3. The system as recited in claim 1 wherein said power regulation valve is a solenoid valve.

4. The system as recited in claim 1 wherein at least one of said pressure regulation valve and said release valve has a pressure flow line tap coupled thereto.

5. The system as recited in claim 1 wherein said release valve is coupled to a pulse tube, said pulse tube being integrated within the pulse tube refrigerator, said release valve releasing fluid from said pulse tube for cooling a hot heat exchanger integrated within the pulse tube refrigerator.

6. The system as recited in claim 1 wherein said driving gas volume cools a hot heat exchanger of the pulse tube refrigerator after driving said pneumatic motor.

7. The system as recited in claim 1 wherein said fluid is helium.

8. The system as recited in claim 1 wherein the pulse tube refrigerator is a two-stage pulse tube refrigerator.

9. The system as recited in claim 1 wherein the pulse tube refrigerator comprises:

an electric compressor for increasing said fluid pressure of said fluid to said predetermined pressure range;

an aftercooler coupled to said electric compressor, said aftercooler receiving said fluid from said electric compressor, said aftercooler cooling said fluid, said rotary valve coupled to said aftercooler, said rotary valve receiving said fluid from said aftercooler, said rotary valve oscillating said fluid to a predetermined pressure oscillation;

a regenerator coupled to said rotary valve, said regenerator receiving said fluid from said rotary valve, said regenerator cooling said fluid;

a cold heat exchanger coupled to said regenerator, said cold heat exchanger receiving said fluid from said regenerator, said load transferring heat to said fluid;

a pulse tube coupled to said cold heat exchanger, said pulse tube receiving said fluid from said cold heat exchanger, said pulse tube transporting said fluid away from said cold heat exchanger;

a hot heat exchanger coupled to said pulse tube, said hot heat exchanger receiving said fluid from said pulse tube, said hot heat exchanger cooling said fluid;

an orifice coupled to said hot heat exchanger, said orifice providing a desired phase shift between a gas flow and said predetermined pressure range; and a reservoir coupled to said orifice, said reservoir receiving said fluid and providing a desired phase shift between a gas flow and said predetermined pressure range.

10. The system as recited in claim 1 further comprising:

an electricity sensor coupled to the pulse tube refrigerator for detecting an electrical current provided thereto; and a controller coupled to said electricity sensor, said controller detecting said electrical current, said controller determining whether said electrical current is within a predetermined power supply range, said controller actuating said power regulation valve for regulating said fluid pressure within said predetermined pressure range.

11. The system as recited in claim 1 further comprising:

a pressure sensor coupled to the pulse tube refrigerator for detecting said fluid pressure therein; and a controller coupled to said pressure sensor, said controller detecting said fluid pressure, said controller determining whether said fluid pressure is within said predetermined pressure range, said controller actuating said pressure regulation valve and said release valve for regulating said fluid pressure within said predetermined pressure range.

12. A system for providing a ridethrough reserve for a pulse tube refrigerator, the system comprising:

a pressurized tank containing a fluid for cooling a load;

a pressure regulation valve coupling said pressurized tank to a rotary valve of the pulse tube refrigerator, said pressure regulation valve releasing said fluid from said pressurized tank and increasing a fluid pressure within the pulse tube refrigerator to a predetermined pressure range during said electrical power supply failure;

a pneumatic motor operatively coupled to said rotary valve, said pneumatic motor driving said rotary valve during said electrical power supply failure;

a power regulation valve coupling said pressurized tank to said pneumatic motor, said power regulation valve providing a driving gas volume for driving said pneumatic motor during said electrical power supply failure;

a release valve coupled to the pulse tube refrigerator for decreasing said fluid pressure to said predetermined pressure range during said electrical power supply failure;

an electricity sensor coupled to the pulse tube refrigerator for detecting an electrical current provided thereto; and a pressure sensor coupled to the pulse tube refrigerator for detecting said fluid pressure therein; and a controller coupled to said pressure sensor and said electricity sensor, said controller detecting said fluid pressure and said electrical current, said controller determining whether said fluid pressure is within said predetermined pressure range, said controller determining whether said electrical current is within a predetermined power supply range, said controller actuating said pressure regulation valve, power regulation valve, and said release valve for regulating said fluid pressure within said predetermined pressure range.

13. A method for providing a ride-through reserve for a pulse tube refrigerator of an MRI scanner, the method comprising the steps of:

providing the pulse tube refrigerator having a fluid therein for cooling a load coupled thereto;

providing a pneumatic motor operatively coupled to the pulse tube refrigerator;

actuating said pneumatic motor during a power supply failure; and oscillating a fluid pressure within a predetermined pressure range during said power supply failure.

14. The method as recited in claim 13 further comprising the step of:

increasing said fluid pressure within the pulse tube refrigerator to a predetermined pressure range.

15. The method as recited in claim 14 wherein the step of increasing said fluid pressure comprises the step of supplying a reserve fluid to the pulse tube refrigerator.

16. The method as recited in claim 15 wherein the step of supplying said reserve fluid comprises employing a pressure regulation valve coupled between the pulse tube refrigerator and a pressurized tank containing said reserve fluid, said pressure regulation valve being a pressure flow line tap.

17. The method as recited in claim 13 wherein the step of actuating said pneumatic motor comprises the step of supplying a driving gas volume to said pneumatic motor.

18. The method as recited in claim 17 wherein the step of supply a driving gas volume comprises employing a power regulation valve coupled between said pneumatic motor and the pulse tube refrigerator, said power regulation valve being a solenoid valve.

19. The method as recited in claim 13 further comprising the step of:

releasing said fluid from the pulse tube refrigerator.

20. The method as recited in claim 19 wherein the step of decreasing said fluid pressure comprises the step of cooling at least one of said load and a hot heat exchanger of the pulse tube refrigerator.

* * * * *